US006135866A

United States Patent [19]

Wang

[11] Patent Number: 6,135,866

[45] Date of Patent: Oct. 24, 2000

[54] GRINDING DEVICE FOR TOOLS

[76] Inventor: Wen Teng Wang, No. 315, Sec. 3, Hui Chung Road, Nan Tun Chu, Taichung, Taiwan

[21] Appl. No.: 09/342,038

[22] Filed: Jun. 28, 1999

[51] Int. Cl.[7] ..... B24B 21/00

[52] U.S. Cl. ..... 451/296; 451/297; 451/300; 451/311

[58] Field of Search ..... 451/296, 297, 451/299, 300, 305, 306, 307, 311, 336

[56] References Cited

U.S. PATENT DOCUMENTS 4,015,370 4/1977 Lieser .
4,203,261 5/1980 Davies .
4,987,701 1/1991 Humbert .
5,193,314 3/1993 Wormley et al. .
5,863,238 1/1999 Felstehausen .

*Primary Examiner*—Timothy V. Eley
*Assistant Examiner*—Willie Berry, Jr.
*Attorney, Agent, or Firm*—Bacon & Thomas

[57] ABSTRACT

A grinding device includes a grinding member disposed on a base, and a board rotatably supported in the base at a shaft. An axle is rotatably secured in the board for supporting the tools. A spring is coupled between the base and the board for moving the axle and thus the tools toward the grinding member and for allowing the tools to be ground by the grinding member. The grinding member is rotated to grind the tools. A rack is coupled to the axle to rotate the tools for allowing the peripheral portion of the tools to be ground by the grinding member.

14 Claims, 8 Drawing Sheets

GRINDING DEVICE FOR TOOLS

BACKGROUND OF THE INVENTION

1. Field of the Invention

The present invention relates to a grinding device, and more particularly to a grinding device for tools.

2. Description of the Prior Art

Typical tools, such as the wrenches, include a curved or circular outer peripheral surface that are required to be ground manually before they are treated by such as the heat treatment, and/or the electroplating processes. However, a lot of man power is required for grinding the tools, and it is time consuming to grind the tools manually.

The present invention has arisen to mitigate and/or obviate the afore-described disadvantages of the conventional tool grinding devices.

SUMMARY OF THE INVENTION

The primary objective of the present invention is to provide a grinding device for grinding the outer peripheral surface, particularly the curved or circular outer peripheral surface of the tools.

In accordance with one aspect of the invention, there is provided a grinding device for tools comprising a grinding member disposed on a base, a shaft rotatably supported in the base, a board secured to the shaft and rotated in concert with the shaft, an axle rotatably secured in the board for supporting the tools thereon, means for biasing the axle toward the grinding member to engage the tools with the grinding member; and means for rotating the axle relative to the board. The grinding member is provided to grind the tools when the axle is rotated by the rotating means.

The grinding member may be an endless belt. A tightening means may further be provided for tightening the endless belt. A motor may be coupled to the belt for driving the endless belt. A moving means is further provided for adjusting the shaft upward and downward relative to the base.

An actuator is coupled to the board for rotating the board about the shaft to disengage the axle from the grinding member. A bolt is engaged with the board for limiting a rotational movement of the board relative to the base. The base includes a wall secured thereon, the biasing means includes a beam slidably engaged through the wall and having a first end secured to the board and having a second end, and a spring engaged on the beam and engaged between the second end of the beam and the wall for biasing the board toward the wall.

The rotating means includes a gear secured on the axle, a rack slidably secured to the board and engaged with the gear, and means for moving the rack relative to the board. A box is secured to the board and includes a chamber formed therein for rotatably receiving the gear and includes a channel formed therein for slidably receiving the rack. A barrel is engaged on the rack and secured to the box for slidably securing the rack to the box.

A follower is secured to the base, and a mold piece is secured to the axle and rotated in concert with the axle, and biased to engage with the follower by the biasing means for determining an engagement of the tools with the grinding member.

A seat is further secured to the axle and rotated in concert with the axle, and means for securing the tools to the axle. The axle includes a sleeve secured thereon and having an arm extended from the sleeve, the seat is adjustably secured on the arm. The securing means includes an actuator secured on the seat, and at least one panel secured on the actuator and coupled to the actuator for allowing the actuator to actuate the at least one panel to secure the tools in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
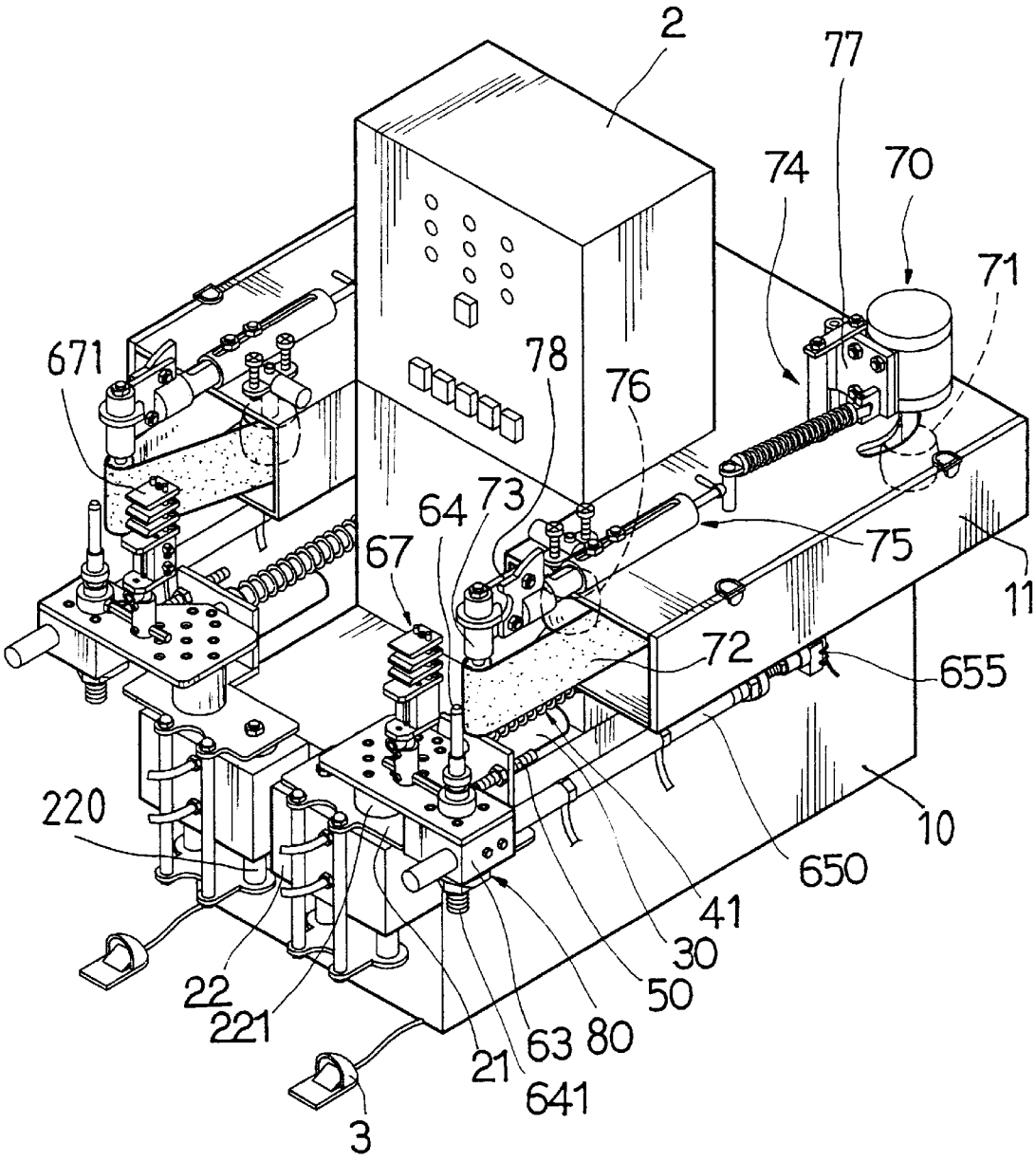
FIG. 1 is a perspective view of a grinding machine having two grinding devices in accordance with the present invention.
Figure 2:
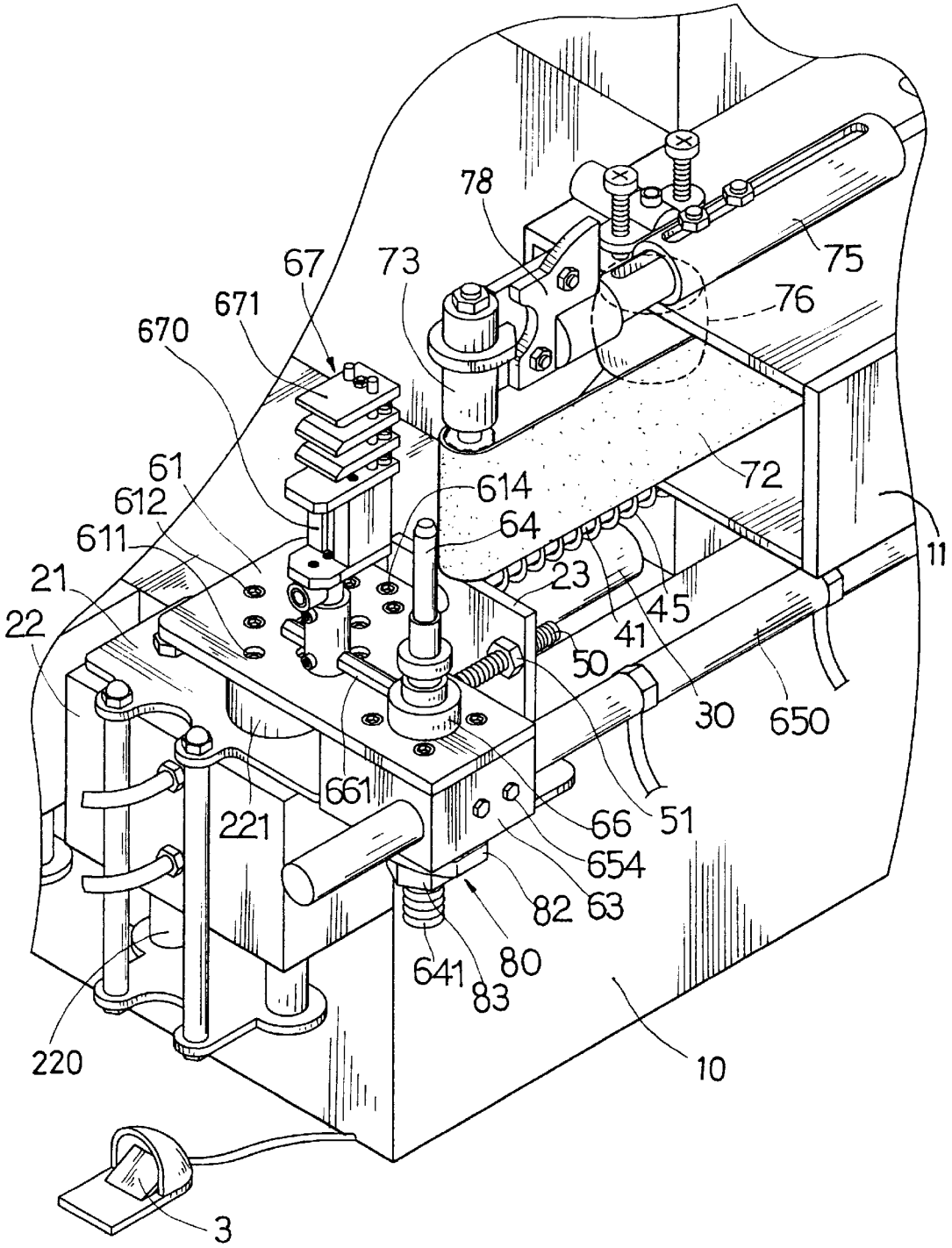
FIG. 2 is a partial perspective view showing one of the grinding devices.

Referring to the drawings, and initially to FIGS. 1 and 2, a grinding machine in accordance with the present invention comprises a base 10 including one or more grinding devices disposed on top of the base 10 and including a computer or a processing unit 2 disposed on the base 10 and coupled to the grinding devices for controlling the grinding devices. As shown in FIG. 1, two grinding devices are disposed on the base 10, however, only one of the grinding devices will be discussed.

Figure 3:
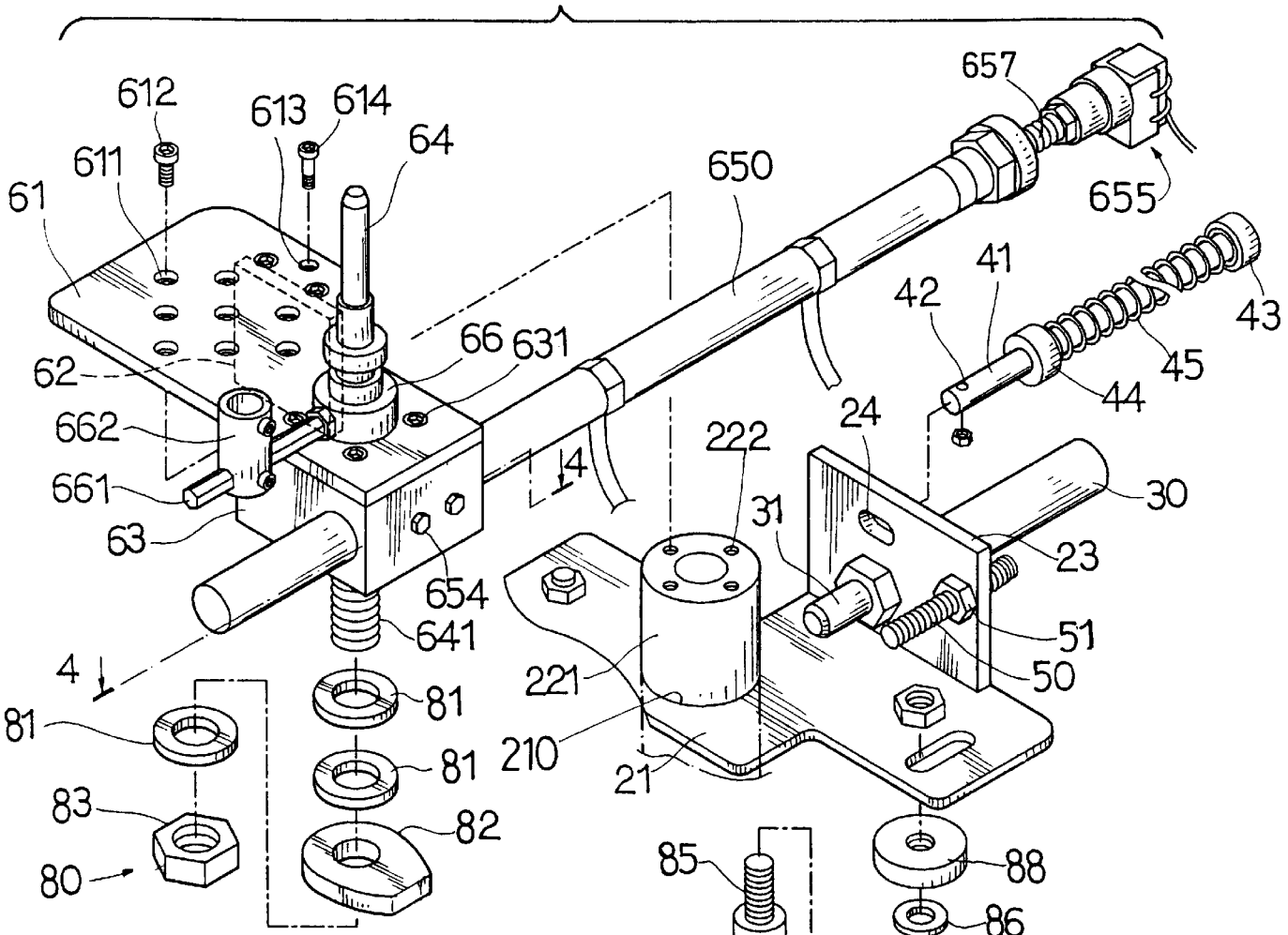
FIG. 3 is a partial exploded view of the grinding device.
Figure 5:
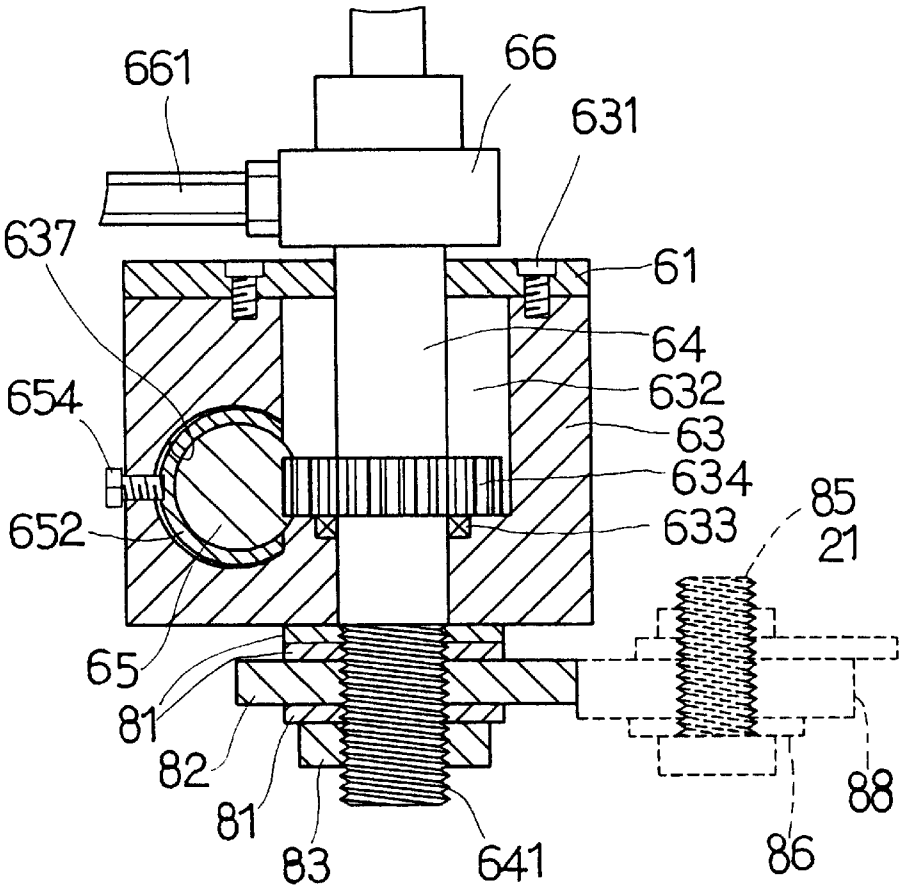
FIG. 5 is a cross sectional view taken along lines 5—5 of FIG. 4.
Figure 4:
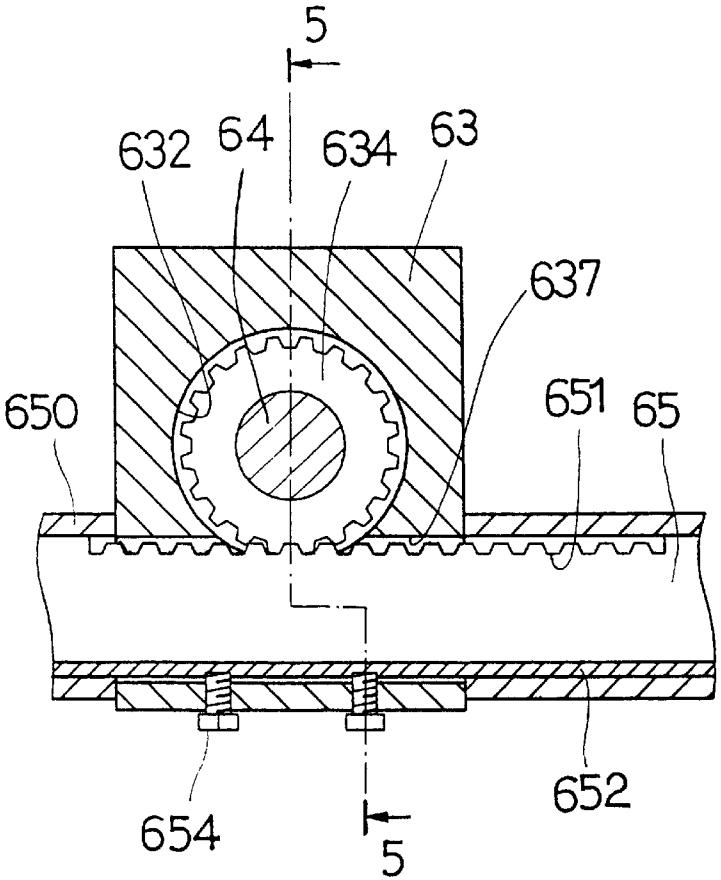
FIG. 4 is a partial cross sectional view taken along lines 4—4 of FIG. 3.

Referring next to FIGS. 3–5, and again to FIGS. 1 and 2, the grinding device includes a housing 11 disposed on the base 10. A motor 70 (FIG. 1) is pivotally secured on the housing 11 by a bracket 77 at a pivot pole 74 and includes a pulley or a wheel 71 secured to the spindle thereof for allowing the wheel 71 to be driven by the motor 70. An actuator 75, such as a hydraulic or pneumatic cylinder is disposed on the housing 11. A rod 73 is rotatably secured in a bracket 78 which is secured to the actuator 75. A grinding member 72, such as an endless grinding belt or grinding cloth, is engaged around the rod 73 and the wheel 71 such that the motor 70 may drive and move the grinding member 72. The actuator 75 may move the rod 73 toward and away from the wheel 71 for adjusting the tightness of the grinding member 72. Another wheel 76 may further be adjustably secured to the housing 11 for adjusting the tightness of the grinding member 72. The grinding member 72 may also be fixedly disposed on the housing 11 or may be moved by the other actuating device in a reciprocating action.

A block 22 (FIGS. 1, 2) is slidably secured in the base 10 and actuated to move up and down by one or more actuators 220, and includes a shaft 221 rotatably secured therein and having one or more screw holes 222 formed therein. A plate 21 is secured on the base 10 and includes a hole 210 formed therein for rotatably receiving the shaft 221, and includes a wall 23 extended upward therefrom. An actuator 30 is secured to the wall 23 and includes a piston rod 31 extended through the wall 23. The wall 23 includes an aperture 24 formed therein for slidably receiving a beam 41. The beam 41 includes a head 43 formed on one end thereof and includes a slide 44 slidably engaged thereon, and a spring 45 is engaged on the beam 41 and engaged between the head 43 of the beam 41 and the slide 44. A bolt 50 is adjustably secured to the wall 23 by a nut 51. A follower 88 is secured to the plate 21 by a fastener 85 and one or more washers 86.

Figure 6:
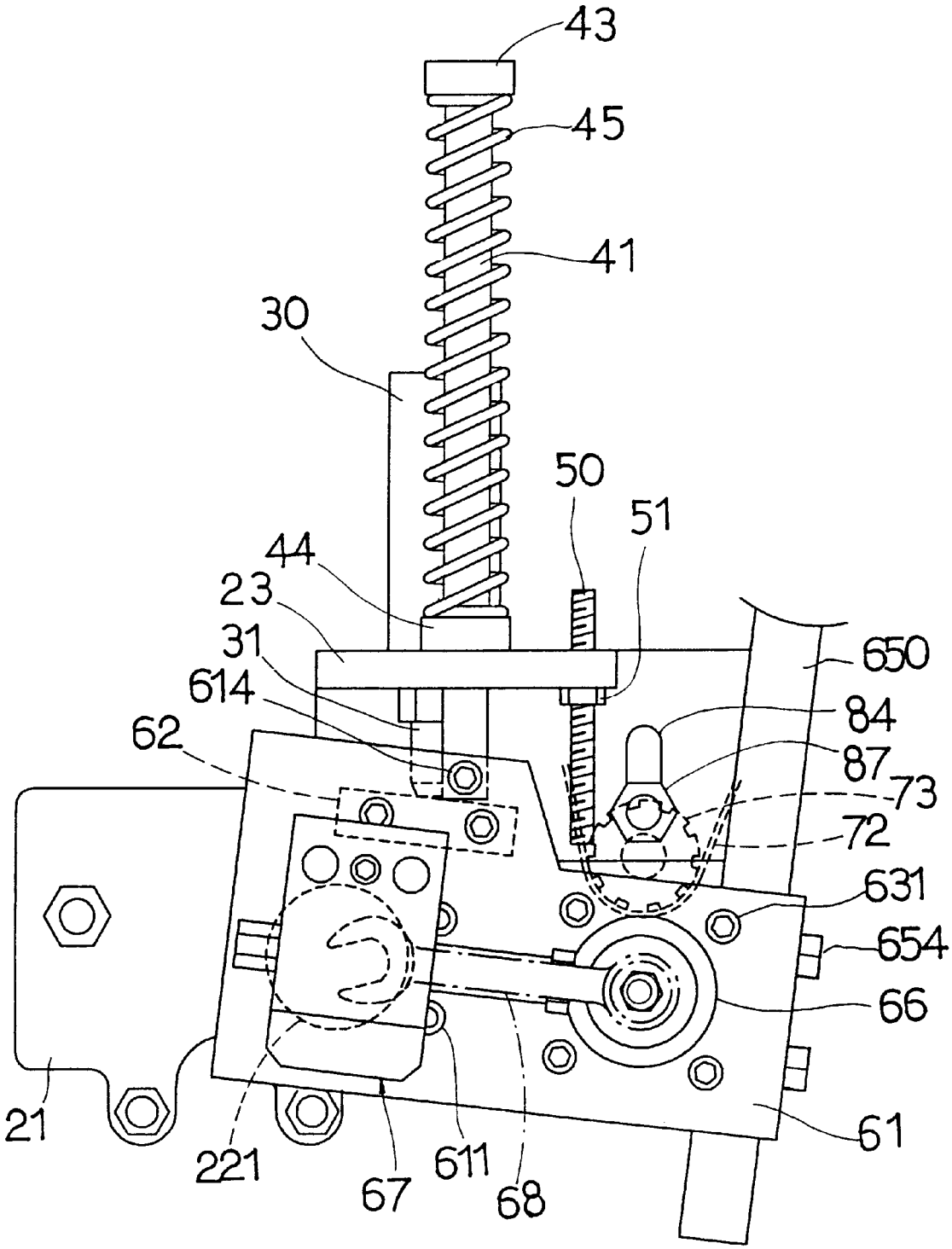
FIGS. 6, 7, 8 are schematic views illustrating the operation of the grinding device.
Figure 7:
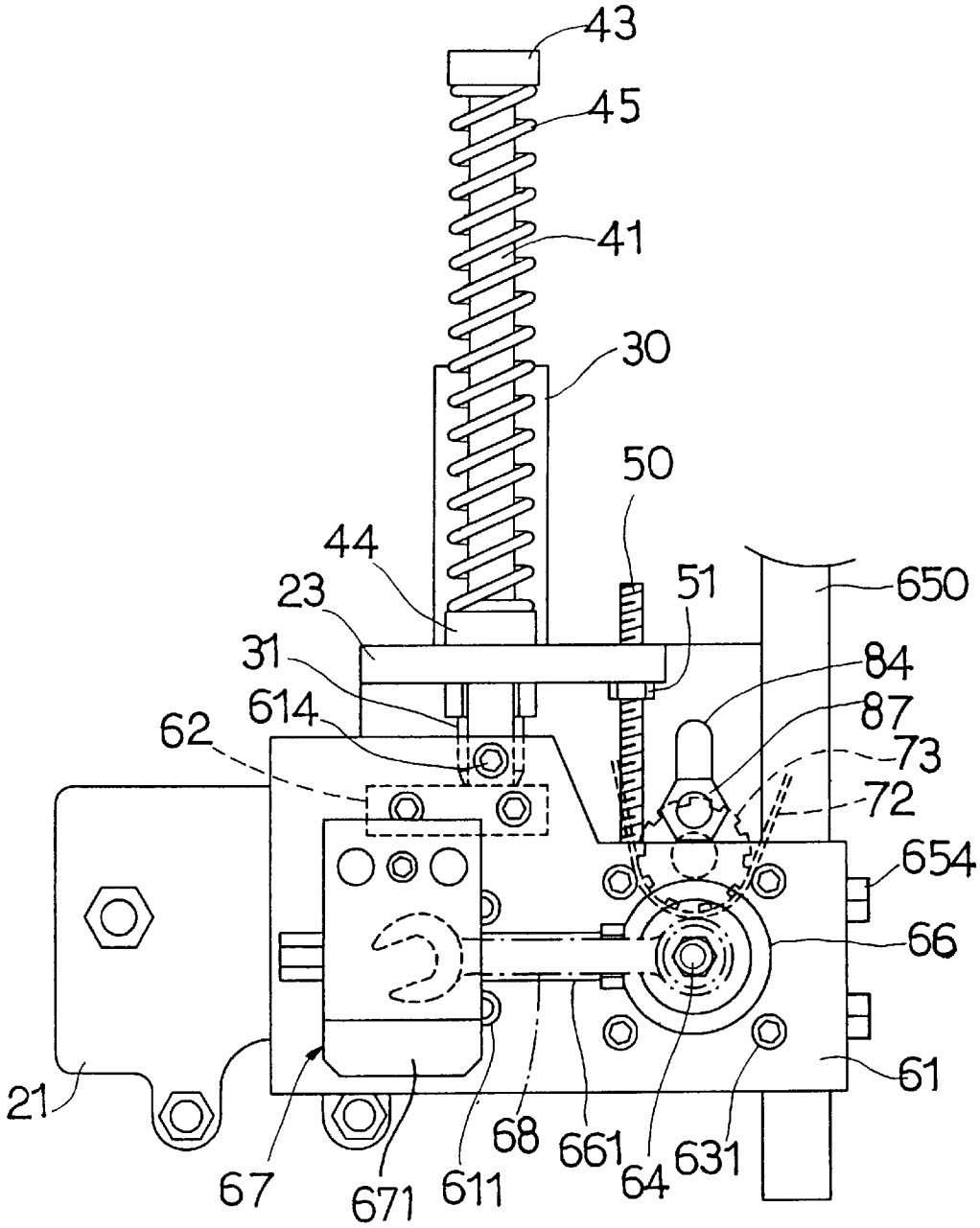
Figure 8:
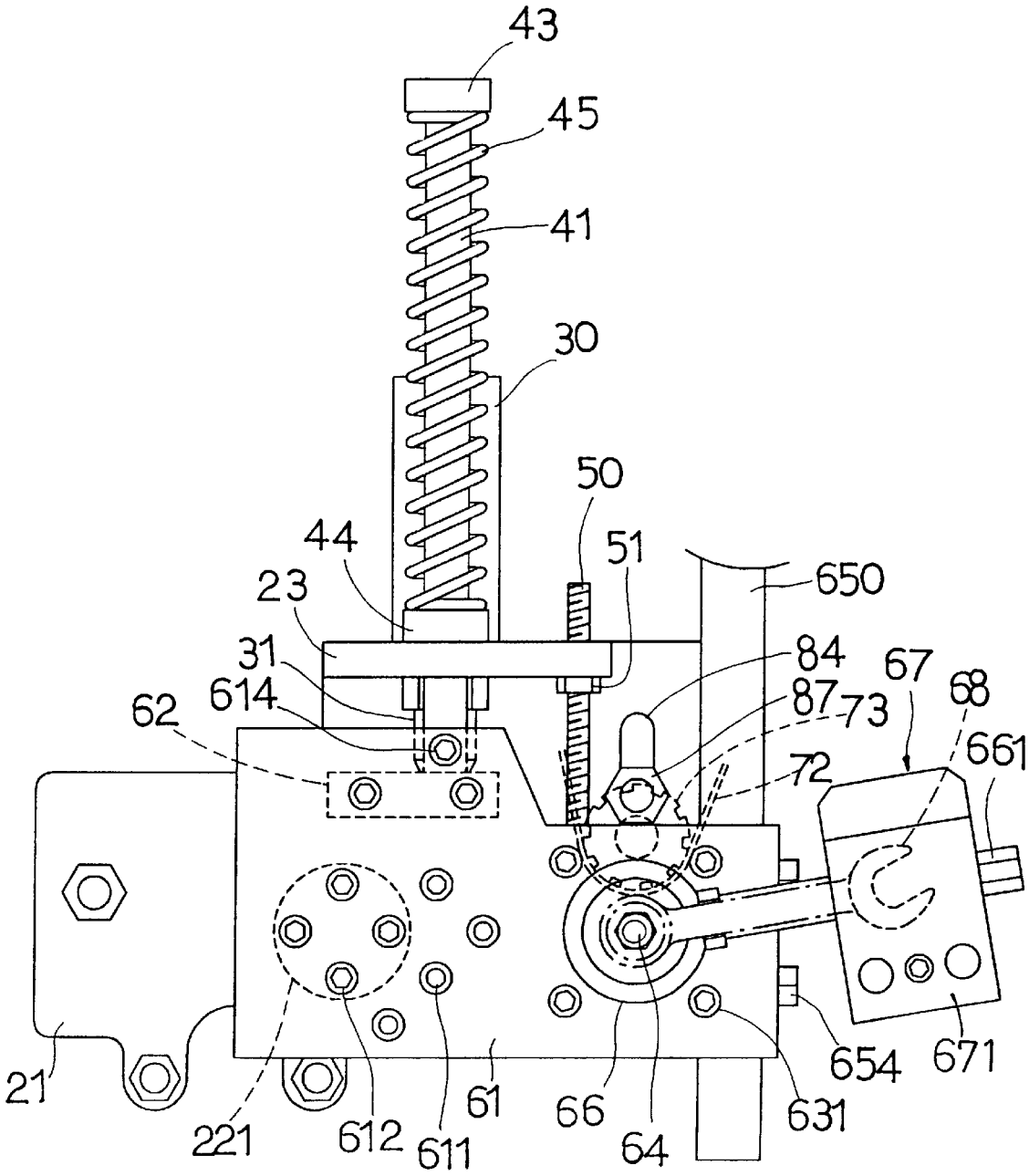

A board 61 includes one or more holes 611 formed therein for receiving fasteners 612 which may engage with the screw holes 222 of the shaft 221 for securing the board 61 to the shaft 221 and for allowing the board 61 to be rotated in concert with the shaft 221. A fastener 614 is engaged through a hole 613 of the board 61 and engaged through one end 42 of the beam 41 such that the spring 45 may bias the board 61 to rotate toward the wall 23 about the shaft 221. The board 61 includes a fin 62 extended downward therefrom and engaged with the piston rod 31 of the actuator 30 such that the actuator 30 may move the board 61 to rotate about the shaft 221 against the spring 45 (FIG. 6). A gear box 63 is secured to the board 61 by fasteners 631. The bolt 50 may engage with the gear box 63 (FIGS. 2, 7, 8) for limiting the rotational movement of the board 61 by the pulling of the spring 45.

Figure 9:
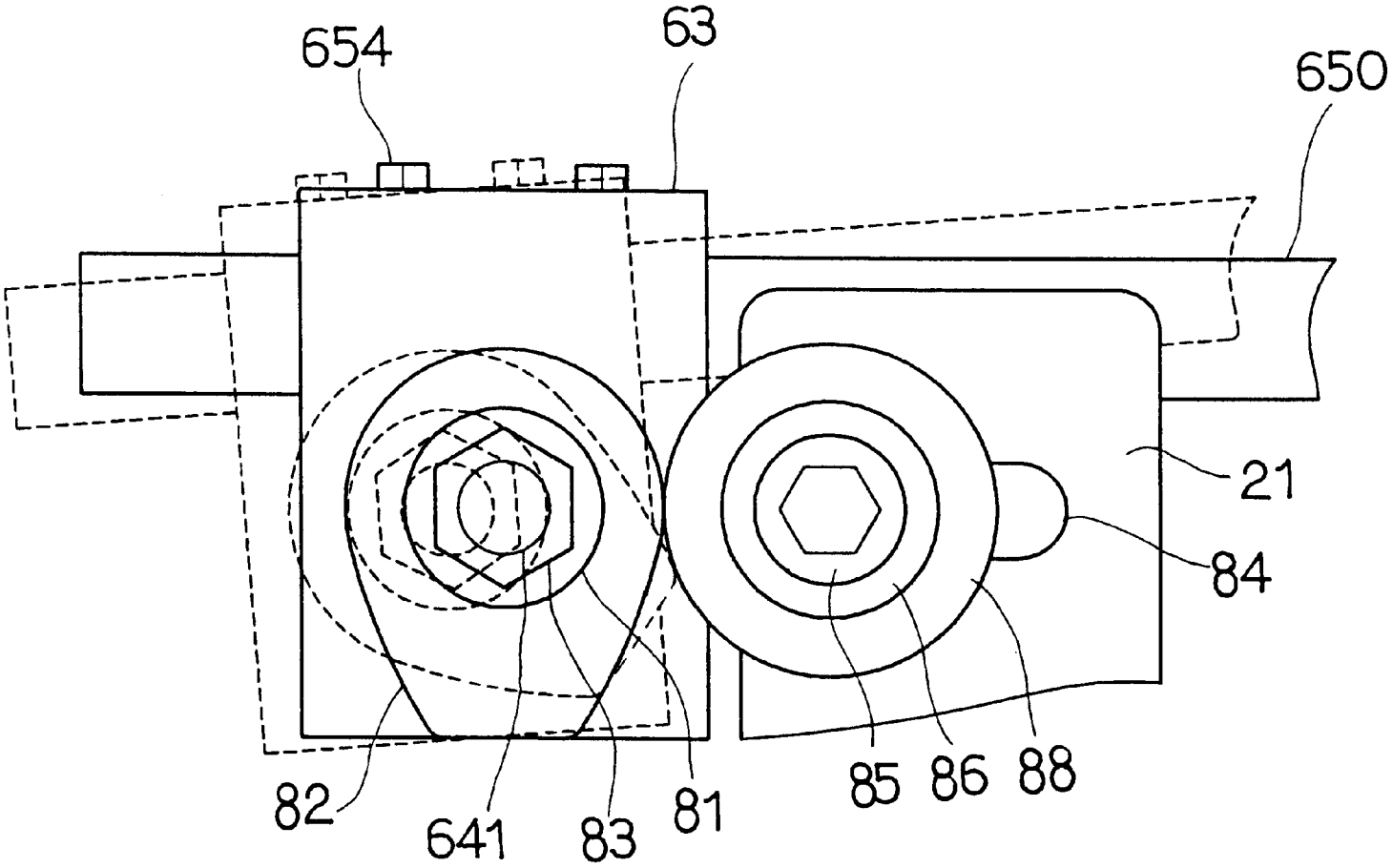
FIG. 9 is a schematic view illustrating the operation of the grinding device.

An axle 64 includes a middle portion rotatably received in the gear box 63 and includes a gear 634 rotatably received in a chamber 632 of the gear box 63 by a bearing 633 and includes an outer thread 641 formed on the lower portion thereof. A mold piece 82 is secured to the lower portion of the axle 64 by washers 81 and a fastener 80, such as a nut 83 that is threaded to the outer thread 641 of the axle 64, such that the mold piece 82 may be rotated by the axle 64. The position of the mold piece 82 may be adjusted by the washers 81 so as to be aligned with and biased to engage with the follower 88 (FIGS. 5, 9) by the spring 45. A sleeve 66 is secured on the axle 64 and rotated in concert with the axle 64 and includes an arm 661 extended therefrom. A seat 662 is adjustably secured on the arm 661 and may be adjusted toward and away from the axle 64. A clamping device 67 includes an actuator 670 secured on the seat 662 and includes one or more panels 671 actuated by the actuator 670 to clamp one end of one or more tools, such as the wrenches 68 (FIGS. 6–8) in place. The other end of the tools 68 is engaged on the axle 64 and may be biased to engage with the grinding member 72 (FIGS. 7, 8) by the spring 45 such that the tools 68 may be ground by the grinding member 72. The shape of the mold piece 82 is made corresponding to that of the tools 68 to be ground.

As shown in FIGS. 2–5, the gear box 63 includes a channel 637 laterally formed therein and communicating with the chamber 632 thereof for slidably receiving a rack 65 which includes one or more teeth 651 engaged with the gear 634, such that the axle 64 may be rotated by the rack 65. A C-shaped barrel 652 is engaged on the rack 65 and includes an opening for allowing the teeth 651 of the rack 65 to be engaged with the gear 634. The barrel 652 is secured to the gear box 63 by fasteners 654 for slidably securing the rack 65 to the gear box 63. A tube 650 is engaged on the rack 65, and an actuator 655 is secured to the tube 650 by such as a tubular member 657 and is coupled to the rack 65 for moving the rack 65 to rotate the axle 64 and the tools 68 and for allowing the tools 68 to be ground by the grinding member 72.

In operation, as shown in FIG. 6, the axle 64 and the gear box 63 and the board 61 may be rotated about the shaft 221, against the spring 45, by the actuator 30 in order to move the axle 64 away from the grinding member 72 and for allowing the tools 68 to be engaged on the axle 64 and to be secured in place by the panels 671 of the clamping device 67. The board 61 may be adjusted upward and downward by the actuators 220 of the block 22 in order to adjust the position of the tools 68 relative to the grinding member 72. When the actuator 30 is released, the spring 45 may bias the tools 68 to engage with the grinding member 72 for allowing the tools 68 to be ground by the grinding member 72. The engagement of the tools 68 with the grinding member 72 may be determined by the engagement between the mold piece 82 and the follower 88. However, without the mold piece 82, the tools 68 may also be biased to engage with the grinding member 72 by the spring 45 such that the tools 68 may also be ground by the grinding member 72 without the mold piece 82. The peripheral surfaces of the other ends of the tools 68 may also be ground by the grinding member 72 when the ends of the tools 68 are adjusted.

Accordingly, the grinding device in accordance with the present invention may be used for grinding the outer peripheral surface, particularly the curved or circular outer peripheral surface of the tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A grinding device for tools comprising:

a base, a grinding member disposed on said base, a shaft rotatably supported in said base, a board secured to said shaft and rotated in concert with said shaft, an axle rotatably secured in said board for supporting the tools thereon, means for biasing said axle toward said grinding member to engage the tools with said grinding member;

means for rotating said axle relative to said board, and means for rotating said board about said shaft to disengage said axle from said grinding member, said grinding member being provided to grind the tools when said axle is rotated by said rotating means.

2. The grinding device according to claim 1, wherein said grinding member includes an endless belt.

3. The grinding device according to claim 2 further comprising means for tightening said endless belt.

4. The grinding device according to claim 2 further comprising means for driving said endless belt.

5. The grinding device according to claim 1 further comprising means for adjusting said shaft upward and downward relative to said base.

6. The grinding device according to claim 1 further comprising means for limiting a rotational movement of said board relative to said base.

7. A grinding device for tools comprising:

a base, a grinding member disposed on said base, a shaft rotatable supported in said base, a board secured to said shaft and rotated in concert with said shaft, an axle rotatably secured in said board for supporting the tools thereon, means for biasing said axle toward said grinding member to engage the tools with said grinding member; and means for rotating said axle relative to said board, said grinding member being provided to grind the tools when said axle is rotated by said rotating means, wherein said base includes a wall secured thereon, said biasing means includes a beam slidably engaged through said wall and having a first end secured to said board and having a second end, and a spring engaged on said beam and engaged between said second end of said beam and said wall for biasing said board toward said wall.

8. A grinding device for tools comprising:

a base, a grinding member disposed on said base, a shaft rotatable supported in said base, a board secured to said shaft and rotated in concert with said shaft, an axle rotatable secured in said board for supporting the tools thereon, means for biasing said axle toward said grinding member to engage the tools with said grinding member; and means for rotating said axle relative to said board, said grinding member being provided to grind the tools when said axle is rotated by said rotating means, wherein said rotating means includes a gear secured on said axle, a rack slidably secured to said board and engaged with said gear, and means for moving said rack relative to said board.

9. The grinding device according to claim 8 further comprising a box secured to said board and including a chamber formed therein for rotatably receiving said gear and including a channel formed therein for slidably receiving said rack.

10. The grinding device according to claim 9 further comprising a barrel engaged on said rack and secured to said box for slidably securing said rack to said box.

11. The grinding device according to claim 1 further comprising a follower secured to said base, and a mold piece secured to said axle and rotated in concert with said axle, said mold piece being biased to engage with said follower by said biasing means for determining an engagement of the tools with said grinding member.

12. The grinding device according to claim 1 further comprising a seat secured to said axle and rotated in concert with said axle, and means for securing the tools to said axle.

13. The grinding device according to claim 12, wherein said axle includes a sleeve secured thereon and having an arm extended from said sleeve, said seat is adjustably secured on said arm.

14. The grinding device according to claim 12, wherein said securing means includes an actuator secured on said seat, and at least one panel secured on said actuator and coupled to said actuator for allowing said actuator to actuate said at least one panel to secure the tools in place.

* * * * *